US005915761A

United States Patent [19]

Moriya et al.

[11] Patent Number: 5,915,761

[45] Date of Patent: Jun. 29, 1999

[54] METHOD OF PRODUCING A POLYMER LP INSULATOR

[75] Inventors: Tsutomu Moriya, Chita; Takeshi Shogo, Kani, both of Japan; Shuji Fujii, Virginia-Beach, Va.

[73] Assignee: NGK Insulators, Ltd., Japan

[21] Appl. No.: 08/803,103

[22] Filed: Feb. 20, 1997

[30] Foreign Application Priority Data

Feb. 29, 1996 [JP] Japan ..... 8-043196

[51] Int. Cl.[6] ..... H01B 19/00

[52] U.S. Cl. ..... 29/887; 174/209

[58] Field of Search ..... 29/887; 174/176, 174/137 A, 137 B, 137 R, 209; 361/117, 127

[56] References Cited

U.S. PATENT DOCUMENTS

| | | | |
|---|---|---|---|
| 2,014,441 | 9/1935 | Matthews | 29/887 |
| 5,563,379 | 10/1996 | Kunieda et al. | 174/169 |
| 5,633,478 | 5/1997 | Ishino | 174/179 |

FOREIGN PATENT DOCUMENTS

| | | | |
|---|---|---|---|
| 0 617 432 A2 | 9/1994 | European Pat. Off. | H01B 17/02 |
| 0 617 434 A2 | 9/1994 | European Pat. Off. | H01B 17/40 |
| 5-274936 | 10/1993 | Japan . | |
| 6-187861 | 4/1994 | Japan | H01B 17/00 |
| 5-274936 | 10/1994 | Japan | H01B 17/00 |

*Primary Examiner*—Peter Vo
*Assistant Examiner*—Bobby Rushing, Jr.
*Attorney, Agent, or Firm*—Parkhurst & Wendel, L.L.P

[57] ABSTRACT

The disclosed polymer LP insulator having an FRP rod, an insulation overcoat member made of rubber, which is arranged on an outer surface of the FRP rod, and securing metal members clamped at both end portions of the FRP rod, wherein an end portion of the insulation overcoat member is inserted into an end portion of the securing metal member, includes an elastic member arranged in a space defined by the FRP rod, an inner surface of the securing metal member, and an end surface of the insulation overcoat member, wherein a pressure for clamping and fixing is only applied to a connection portion between the securing member and the FRP rod.

The disclosed polymer LP insulator is produced for example by arranging the securing metal member at both ends of the FRP rod; clamping and fixing the securing metal member to the FRP rod by applying a pressure only to a connection portion between the securing metal member and the FRP rod; and forming the insulation overcoat member made of rubber on an outer surface of the FRP rod, and an elastic member in a space defined by the FRP rod, an inner surface of the securing metal member, and an end surface of the insulation overcoat member simultaneously.

6 Claims, 5 Drawing Sheets

METHOD OF PRODUCING A POLYMER LP INSULATOR

BACKGROUND OF THE INVENTION (1) Field of the Invention

The present invention relates to a polymer LP (Line Post) insulator comprising an FRP (Fiber Reinforced Plastics) rod, an insulation overcoat member made of rubber, which is arranged on an outer surface of the FRP rod, and securing metal members clamped at both end portions of the FRP rod, wherein an end portion of the insulation overcoat member is inserted into an end portion of the securing metal member, and also relates to a method of producing a polymer LP insulator having a construction mentioned above.

(2) Related Art Statement

Generally, a polymer LP insulator has been known as a kind of insulators. FIG. 5 is a schematic view showing one construction of the known polymer LP insulator. In the embodiment shown in FIG. 5, a polymer LP insulator 51 comprises an FRP rod 52, an insulation overcoat member 53 made of rubber, which is arranged on an outer surface of the FRP rod 52, and securing metal members 54 clamped at both end portions of the FRP rod 52. In addition, an end portion of the insulation overcoat member 53 is inserted into a space between an end portion of the securing metal member 54 and the FRP rod 52.

The construction of the polymer LP insulator 51 mentioned above is not so different from that of insulators. However, as shown in FIG. 6, the polymer LP insulator 51 is secured to a pole 64 in an inclined manner by means of a securing holder 62, when it is actually used for supporting a transmission line 61. Therefore, since a bending force is applied to a line supporting end of the polymer LP insulator 51, a maximum compression/tensile stress due to such a bending force is generated at a fulcrum point of the FRP rod 52 of the polymer LP insulator 51. In addition, a shearing stress is concentrated at the FRP rod 52 corresponding to a supporting portion of the securing metal member 54 arranged at a pole side.

As shown in FIG. 5 in detail, in the known polymer LP insulator 51 having the construction mentioned above, an end portion of the insulation overcoat member 53 is inserted into an end portion of the securing metal member 54. In this case, there is a space 63 defined by the FRP rod 52, an end portion 53*a* of the insulation overcoat member 53, and an inner surface of an end portion 54*a* of the securing metal member 54. Therefore, if a bending force is applied to a top portion of the polymer LP insulator 51, a stress is liable to be concentrated at a starting point of the space 63 i.e. a connection point 54*b* between the securing metal member 54 and the FRP rod 52, and thus there arises a problem such that micro fractures are sometimes generated.

Moreover, the polymer LP insulator 51 having the construction shown in FIG. 5 is produced by the steps of forming the insulation overcoat member 53 made of rubber on an outer surface of the FRP rod 52, arranging the securing metal member 54 at an end of the FRP rod 52, and clamping and fixing the securing metal member 54 to the FRP rod 52 by applying a pressure to the securing metal members 54. In the clamping and fixing step mentioned above, if there is a space 63 defined by the FRP rod 52, an end portion 53*a* of the insulation overcoat member 53, and an inner surface of an end portion 54*a* of the securing metal member 54*a* mentioned above, there also arises a problem such that a stress is liable to be concentrated at a starting point of the space 63 i.e. a connection point 54*b* between the securing metal member 54 and the FRP rod 52.

According to various factors in an actual use or in a producing step as mentioned above, if a pressure if applied to the top portion of the polymer insulator 51, micro fractures are sometimes generated near the connection point 54*b* between the securing metal member 54 and the FRP rod 52 even under about 50% of an assuring pressure to which the polymer insulator 51 must be endured. Therefore, the known polymer insulator 51 has a room for improving a long term assuring pressure.

In addition, in order to reduce a stress of the securing portion of the polymer insulator, the present applicant discloses a technique in Japanese Laid-Open Publication No.5-274936 such that a cylindrical stress concentration relief member made of FRP is arranged at an open end portion of an inner surface of the securing metal member. However, the technique for the known polymer insulator disclosed in Japanese Patent Laid-Open Publication No.5-274936 is not sufficient to solve the problems mentioned above for the polymer LP insulator to which a bending pressure is applied, and thus the problems mentioned above can not be solved.

SUMMARY OF THE INVENTION

An object of the invention is to eliminate the drawbacks mentioned above and to provide a polymer LP insulator in which no micro cracks are generated in a FRP rod even in an actual use or during production and highly reliable products can be obtained , and a method of producing such a polymer LP insulator.

According to the invention, a polymer LP insulator having an FRP rod, an insulation overcoat member made of rubber, which is arranged on an outer surface of said FRP rod, and securing metal members clamped at both end portions of said FRP rod, wherein an end portion of said insulation overcoat member is inserted into an end portion of said securing metal member, comprises an elastic member arranged in a space defined by said FRP rod, an inner surface of said securing metal member, and an end surface of said insulation overcoat member, wherein a pressure for clamping and fixing is only applied to a connection portion between said securing member and said FRP rod.

Moreover, according to the invention, a method of producing a polymer LP insulator having an FRP rod, an insulation overcoat member made of rubber, which is arranged on an outer surface of said FRP rod, and securing metal members clamped at both end portions of said FRP rod, wherein an end portion of said insulation overcoat member is inserted into an end portion of said securing metal member, comprises the steps of arranging said securing metal member at both ends of said FRP rod;

clamping and fixing said securing metal member to said FRP rod by applying a pressure only to a connection portion between said securing metal member and said FRP rod; and forming said insulation overcoat member made of rubber on an outer surface of said FRP rod, and an elastic member in a space defined by said FRP rod, an inner surface of said securing metal member, and an end surface of said insulation overcoat member simultaneously.

Further, according to the invention, a method of producing a polymer LP insulator having an FRP rod, an insulation overcoat member made of rubber, which is arranged on an outer surface of said FRP rod, and securing metal members clamped at both end portions of said FRP rod, wherein an end portion of said insulation overcoat member is inserted into an end portion of said securing metal member, comprises the steps of arranging said securing metal member at both ends of said FRP rod;

clamping and fixing said securing metal member to said FRP rod by applying a pressure only to a connection portion between said securing metal member and said FRP rod;

arranging an elastic member in a space defined by said FRP rod and an inner surface of said securing metal member; and forming said insulation overcoat member made of rubber on an outer surface of said FRP rod.

In the present invention, various effects of the space in the polymer LP insulator defined by said FRP rod, an inner surface of said securing metal member, and an end surface of said insulation overcoat member are discussed. After that, it is understood that, if the elastic member is arranged in the space and a pressure in the clamping and fixing step is applied only to the connection portion between the securing metal member and the FRP rod, no micro cracks are generated in an actual use or during production even in the polymer LP insulator to which a bending stress is applied.

It should be noted that, in the present invention, a term "connection portion between the securing metal member and the FRP rod" means a region from a bending start point of the end portion of the securing metal to an end portion of the FRP rod.

DESCRIPTION OF THE PREFERRED EMBODIMENTS

Figure 1:
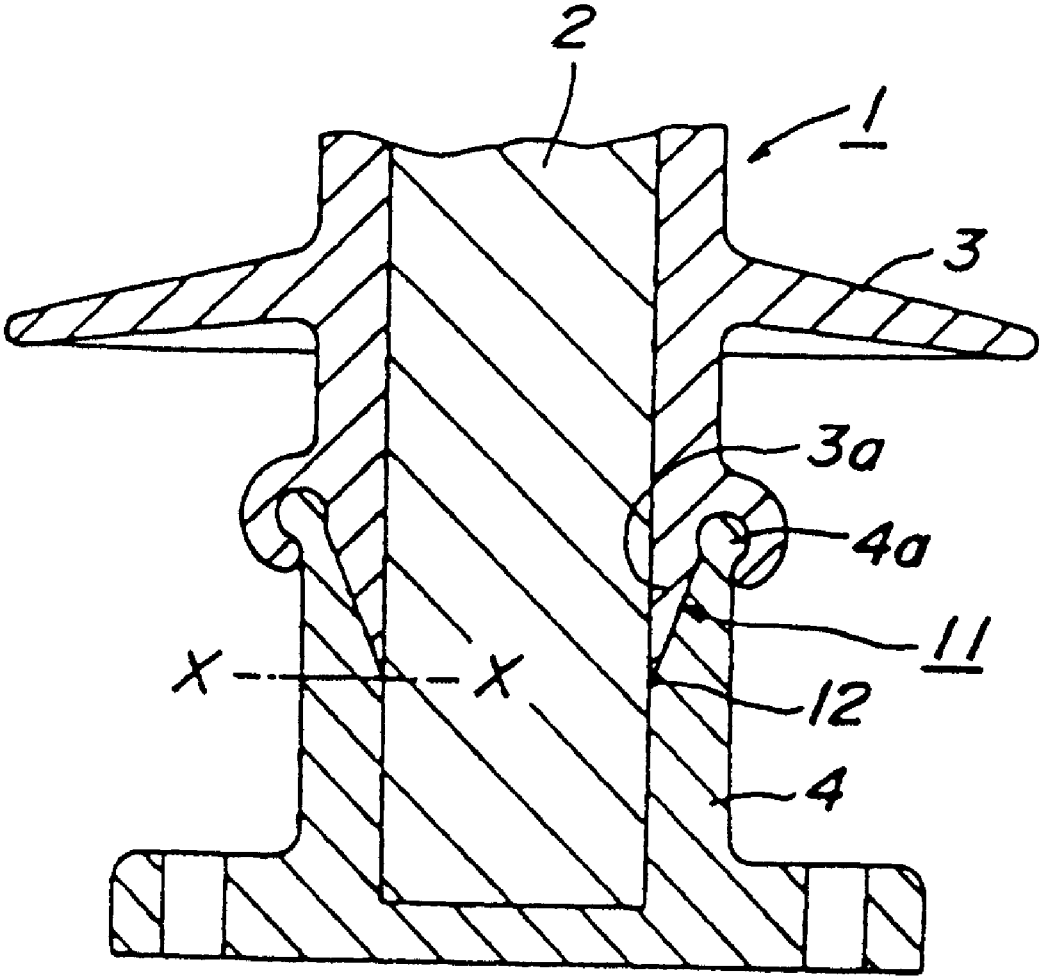
FIG. 1 is a schematic view showing one embodiment of a polymer LP insulator according to the invention.

FIG. 1 is a schematic view showing one embodiment of a polymer LP insulator according to the invention. In the embodiment shown in FIG. 1, a polymer LP insulator 1 comprises an FRP rod 2, an insulation overcoat member 3 made of rubber such as silicone rubber or the like, which is arranged on an outer surface of the FRP rod 2, and securing metal members 4 clamped and fixed at both end portions of the FRP rod 2. Moreover, an end portion of the insulation overcoat member 3 is inserted into an end portion of the securing metal member 4. The construction mentioned above is the same as that of the known polymer LP insulator.

First feature of the polymer LP insulator 1 according to the invention is that all the space 11 defined by an inner surface of an end portion 4*a* of the securing metal member 4 is filled with an end portion 3*a* of the insulation overcoat member 3. Therefore, rubber with the same composition as that of the insulation overcoat member 3 is filled in the end portion 4*a* of the securing metal member 4 toward a curvature starting point 12 at which the end portion 4*a* begins to bend from the FRP rod 2.

As mentioned above, by arranging the elastic member such as silicone rubber in all the space 11 defined by an inner surface of an end portion 4*a* of the securing metal member 4 is filled with an end portion 3*a* of the insulation overcoat member 3, it is possible to prevent effectively a generation of micro cracks in the FRP rod 2 at a portion corresponding to the curvature starting point 12 in an actual use or in a producing step.

Second feature of the polymer LP insulator 1 according to the invention is that, in a clamping step during the producing method, a pressure is applied only to a connection portion between the securing metal member 4 and the FRP rod 2. That is to say, in FIG. 1, an upper end of a portion to which a pressure is applied assumed as X-X plane passing through the curvature starting point 12 and being perpendicular to the FRP rod 2 or a portion lower than the X-X plane.

The polymer LP insulator 1 shown in FIG. 1 is produced by arranging the securing metal member 4 at both ends of the FRP rod 2, clamping and fixing the securing metal member 4 to the FRP rod 2 by applying a pressure only to a connection portion between the securing metal member 4 and the FRP rod 2, and forming the insulation overcoat member 3 made of rubber on an outer surface of the FRP rod 2, and an elastic member in a space 11 defined by the FRP rod 2, an inner surface of the securing metal member 4, and an end surface of the insulation overcoat member 3 simultaneously.

As mentioned above, in a clamping step during the producing method, by applying a pressure only to a connection portion between the securing metal member 4 and the FRP rod 2, a stress due to the applied pressure is not concentrated at a portion of the FRP rod 2 corresponding to the curvature starting point 12, and thus it is possible to prevent effectively a generation of micro cracks during the clamping step. Moreover, in the case that the clamping step is repeated at a plurality of times, if a pressure applied near the curvature starting point 12 at which the securing metal member 4 begins to bond from the FRP rod 2 is smaller than that of a portion remote from the curvature starting point 12, it is possible to prevent more effectively a generation of micro cracks in the FRP rod 2, and thus it is preferable.

Figure 2:
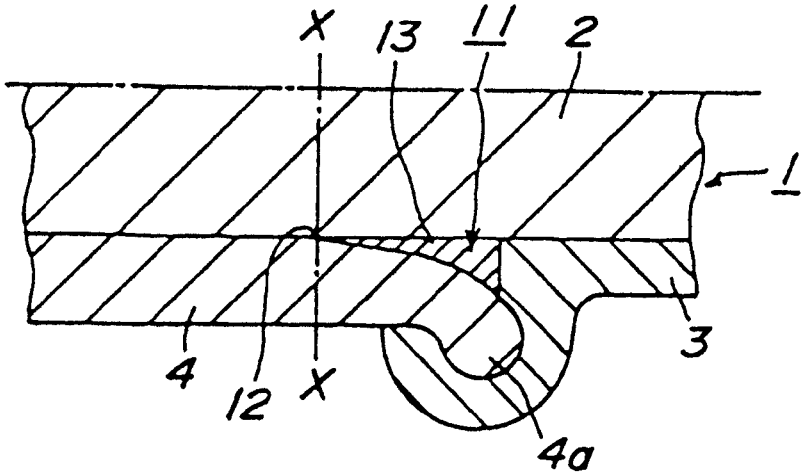
FIG. 2 is a schematic view illustrating another embodiment of a polymer LP insulator according to the invention.
Figure 3:
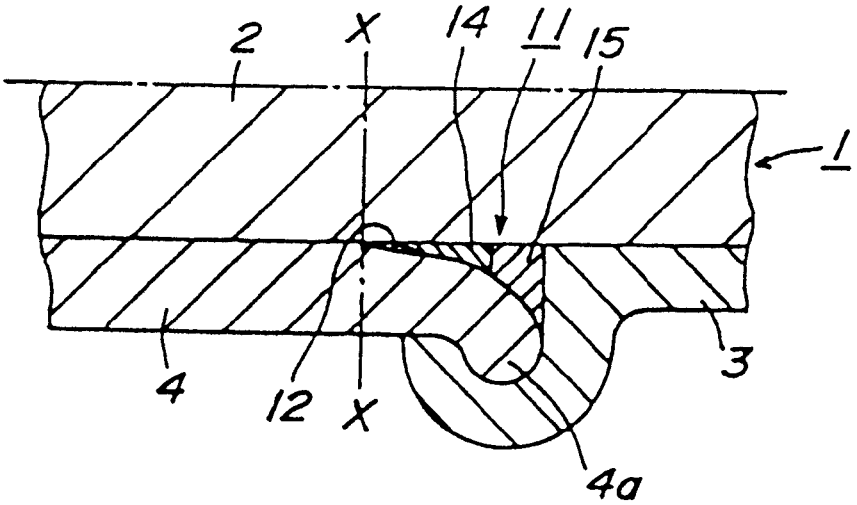
FIG. 3 is a schematic view depicting still another embodiment of a polymer LP insulator according to the invention.

FIGS. 2 and 3 are schematic views respectively showing another embodiment of a polymer LP insulator according to the invention. In the embodiments shown in FIGS. 2 and 3, portions similar to those of FIG. 1 are denoted by the same reference numerals as that of FIG. 1, and the explanation thereof is omitted here. In the embodiments shown in FIGS. 2 and 3, a different point from that of FIG. 1 is that an elastic member 13 other than the insulation overcoat member 3 is arranged in the space 11 defined by the FRP rod 2, an inner surface of the securing metal member 4, and an end of the insulation overcoat member 3.

In the embodiment shown in FIG. 2, the elastic member 13 has an intermediate hardness between those of the securing metal member 4 and the insulation overcoat member 3. Since the securing metal member 4 is made of metal such as stainless steel or the like and the insulation overcoat member 3 is made of rubber such as silicone rubber or the like, it is preferred to use as the elastic member 13 FRP, plastics such as mold resin, EPDM rubber, silicone rubber having a larger hardness as that of the insulation overcoat member 13.

Moreover, if use is made of the elastic member 13 having a hardness inclined property such that a portion adjacent to the securing metal member 4 has substantially same hardness as that of the securing metal member 4, a hardness is gradually decreased toward the insulation overcoat member 3, and a portion adjacent to the insulation overcoat member 3 has substantially same hardness as that of the insulation overcoat member 3, it is possible to prevent effectively a stress concentration at the curvature starting point 12, and thus it is preferable to use a structure of this type.

In the embodiment shown in FIG. 3, in order to decrease gradually a hardness of the elastic member 13 from the securing metal member 4 to the insulation overcoat member 3, the elastic member 13 has a construction such that a first elastic member 14 having hardness relatively large but smaller than that of the securing metal member 4 at a side of the securing metal member 4, and a second elastic member 15 having a hardness smaller than that of the first elastic member 14 but larger than that of the insulation overcoat member 13. Also in this embodiment, as is the same as the embodiment shown in FIG. 2, it is possible to prevent effectively a stress concentration at the curvature starting point 12. It should be noted that, in the embodiment shown in FIG. 3, two elastic members are used to construct the elastic member 13, but the number of the elastic members to be used to construct the elastic member 13 is not limited to two, and three or more elastic members can be used to construct the elastic member 13 if the above hardness relation is satisfied.

The polymer LP insulator shown in FIGS. 2 and 3 can be produced by arranging the securing metal member 4 at both ends of the FRP rod 2, clamping and fixing the securing metal member 4 to the FRP rod 2 by applying a pressure only to a connection portion between the securing metal member 4 and the FRP rod 2, arranging an elastic member in a space 11 defined by the FRP rod 2 and an inner surface of the securing metal member 4, and forming the insulation overcoat member 3 made of rubber on an outer surface of the FRP rod 2.

Figure 4:
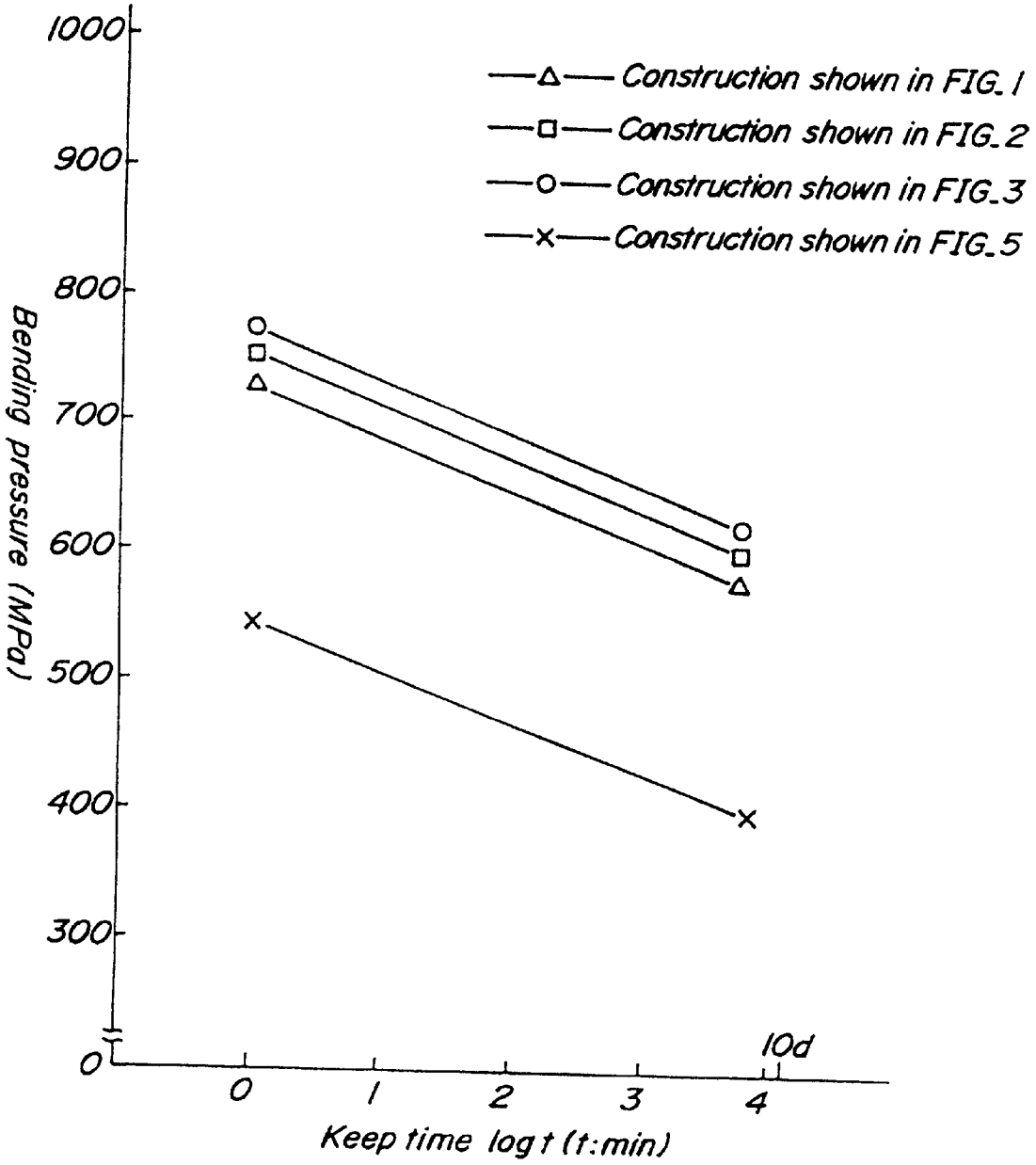
FIG. 4 is a graph showing a result of examining endurable bending pressures of the polymer LP insulators according to the invention and the known example.
Figure 5:
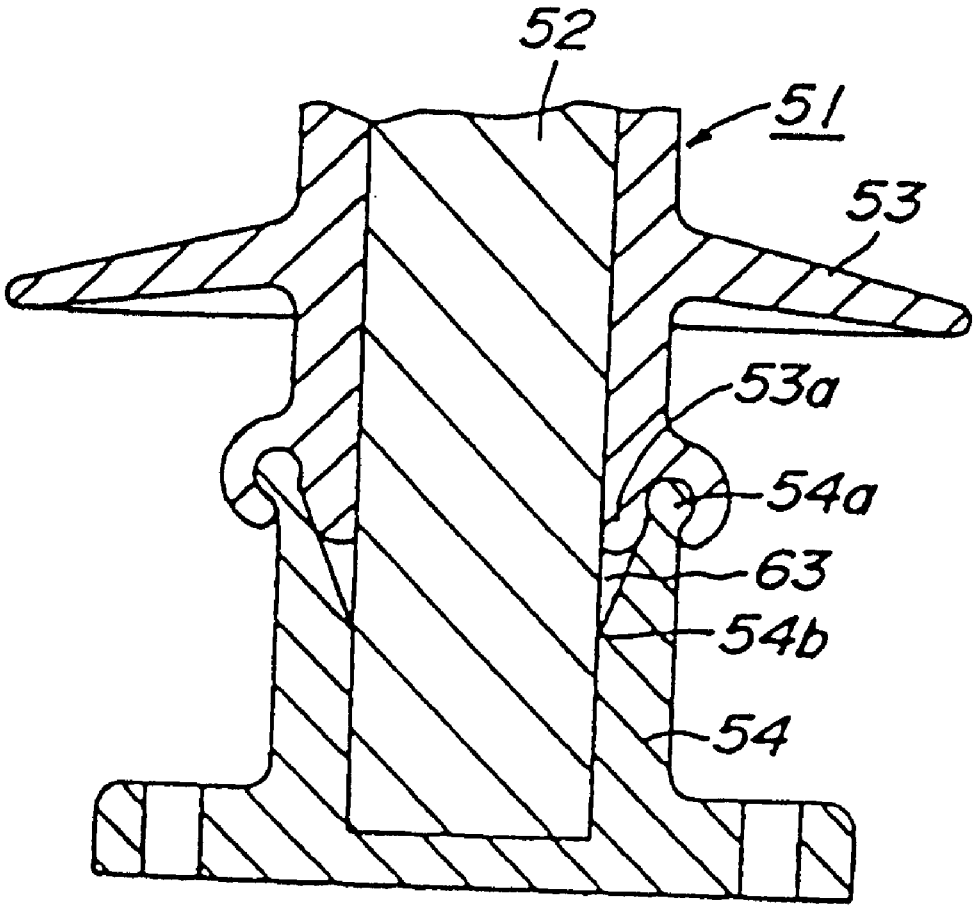
FIG 5 PRIOR ART
FIG. 5 is a schematic view illustrating one embodiment of a known polymer LP insulator.

Actually, the polymer LP insulators shown in FIGS. 1 to 3 according to the invention and the known polymer LP insulator shown in FIG. 5 were prepared. Then, with respect to the polymer LP insulators just after production and the polymer LP insulators which are maintained under pressure for 10 days, a limit bending pressure at which the micro cracks begin to generate in the FRP rod was measured. The results are shown in FIG. 4. From the results shown in FIG. 4, it is understood that the polymer LP insulators shown in FIGS. 1 to 3 according to the invention endure a larger bending pressure both just after production and after being maintained 10 days as compared with the known polymer insulator shown in FIG. 5. Moreover, among the examples according to the invention, it is understood that the examples shown in FIGS. 2 and 3 are preferable as compared with the example shown in FIG. 1.

Figure 6:
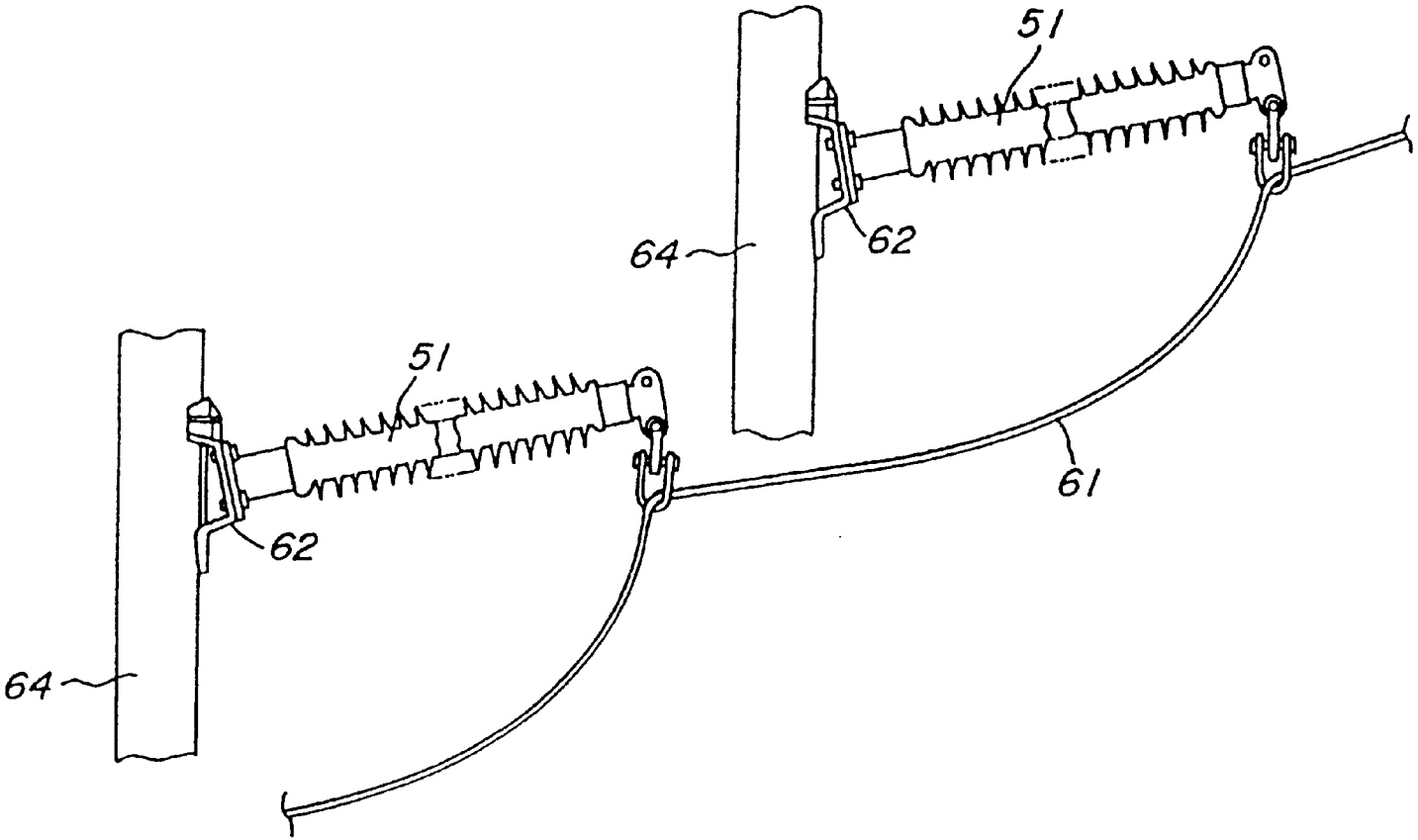
FIG. 6 PRIOR ART
FIG. 6 is a schematic view depicting a state of the polymer LP insulator in an actual use.

In the above embodiments shown in FIGS. 1 to 3, only one end portion of the polymer LP insulator is shown, but the other end portion thereof has the substantially same construction as that of this one end portion except that a shape of the securing metal member 4 is different. Moreover, the polymer LP insulators according to the invention are also used actually in the same manner shown in FIG. 6.

As clearly understood from the above, according to the invention, since the elastic member is arranged in the space defined by the FRP rod, an inner surface of the securing metal member , and an end of the insulation overcoat member, and a pressure is applied only to a connection portion between the securing metal member and the FRP rod in the clamping step, it is possible to prevent a generation of micro cracks in the FRP rod during actual use or clamping stop even in the polymer LP insulator to which a bending pressure is applied.

What is claimed:

1. A method of producing a polymer line post (LP) insulator having (a) a fiber reinforced plastic (FRP) rod, (b) an insulation overcoat member made of rubber and arranged on an outer surface of said FRP rod, and (c) securing metal members, each member having a curvature starting point at which the member begins to bend from the FRP rod, clamped at both end portions of said FRP rod, wherein an end portion of said insulation overcoat member is inserted into an end portion of said securing metal member, said method comprising the steps of arranging said securing metal member at both ends of said FRP rod;

clamping and fixing said securing metal member to said FRP rod applying pressure only to said end portion of said securing metal member where an interior surface of said securing metal member is only in contact with said end portion of said FRP rod; and forming simultaneously both (1) said insulation overcoat member made of rubber on an outer surface of said FRP rod and (2) an elastic member in a space bounded by (i) said FRP rod, (ii) an inner surface of said securing metal member, and (iii) an end surface of said insulation overcoat member.

2. The method of producing a polymer LP insulator according to claim 1, wherein in the clamping and fixing step, a pressure is applied repeatedly at a plurality of times.

3. The method of producing a polymer LP insulator according to claim 2, wherein a pressure applied near a curvature starting point at which said securing metal member begins to bend from said FRP rod is smaller than that of a portion remote from the curvature starting point.

4. A method of producing a polymer line post (LP) insulator having (a) a fiber reinforced plastic (FRP) rod, (b) an insulation overcoat member made of rubber and arranged on an outer surface of said FRP rod, and (c) securing metal members, each member having a curvature starting point at which the member begins to bend from the FRP rod, clamped at both end portions of said FRP rod, wherein an end portion of said insulation overcoat member is inserted into an end portion of said securing metal member, said method comprising the steps of arranging said securing metal member at both ends of said FRP rod;

clamping and fixing said securing metal member to said FRP rod by applying pressure only to said end portion of said securing metal member where an interior surface of said securing metal member is only in contact with said end portion of said FRP rod;

arranging an elastic member in a space bounded by (1) said FRP rod and (2) an inner surface of said securing metal member; and forming said insulation overcoat member made of rubber on an outer surface of said FRP rod.

5. The method of producing a polymer LP insulator according to claim 4, wherein in the clamping and fixing step, a pressure is applied repeatedly at a plurality of times.

6. The method of producing a polymer LP insulator according to claim 5, wherein a pressure applied near a curvature starting point at which said securing metal member begins to bond from said FRP rod is smaller than that of a portion remote from the curvature starting point.

* * * * *